US005730264A

United States Patent [19]

Lu

[11] Patent Number: 5,730,264

[45] Date of Patent: Mar. 24, 1998

[54] LUGGAGE STRUCTURE FOR TRANSPORTING A PLURALITY OF CASES

[75] Inventor: Lien-Ching Lu, Miao-Li Hsien, Taiwan

[73] Assignee: Ting Cheng Co., Ltd., Miao-Li Hsien, Taiwan

[21] Appl. No.: 749,668

[22] Filed: Nov. 15, 1996

[51] Int. Cl.[6] ..... A45C 5/14; A45C 13/38

[52] U.S. Cl. ..... 190/108; 190/18 A; 190/102; 190/115; 280/30; 280/37; 280/655

[58] Field of Search ..... 190/18 A, 115, 190/39, 102, 15.1, 108; 280/37, 655, 655.1, 30

[56] References Cited

U.S. PATENT DOCUMENTS

| | | | |
|---|---|---|---|
| 5,024,455 | 6/1991 | Schrecongost | 190/18 A X |
| 5,108,119 | 4/1992 | Huang | 190/18 A X |
| 5,199,811 | 4/1993 | Huang | 280/655 X |
| 5,294,145 | 3/1994 | Cheng | 280/655 X |
| 5,323,886 | 6/1994 | Chen | 190/18 A |
| 5,374,073 | 12/1994 | Hung-Hsin | 190/18 A X |
| 5,397,151 | 3/1995 | Jserng | 280/655 X |
| 5,433,461 | 7/1995 | Chang | 190/18 A X |
| 5,485,922 | 1/1996 | Butcher | 190/18 A X |
| 5,507,508 | 4/1996 | Liang | 190/18 A X |
| 5,529,322 | 6/1996 | Barton | 280/655 X |

*Primary Examiner*—Sue A. Weaver
*Attorney, Agent, or Firm*—Bacon & Thomas

[57] ABSTRACT

A luggage structure to which an additional luggage case can be freely added. The luggage structure includes a luggage pull rod and a pair of adjustable latch boards. The luggage pull rod includes a pair of inner tubes, a handle, an engaging board and a base seat. The adjustable latch boards includes an upper pressing board and a base board. The upper pressing board is a reverse L-shaped board body having a vertical section disposed with two latch clips on two sides. Each latch clip is disposed with a through hole for the outer tube to pass thereinto and for a bolt to tighten the outer tube. A horizontal section of the pressing board is formed with several through holes for riveting pin members therein so as to secure the additional luggage case. The base board is an L-shaped board body having a vertical section disposed with two latch clips on two sides. Each latch clip is disposed with a through hole for the outer tube to pass thereinto and for a bolt to tighten the outer tube. A horizontal section of the base board is also formed with several through holes.

4 Claims, 4 Drawing Sheets

LUGGAGE STRUCTURE FOR TRANSPORTING A PLURALITY OF CASES

BACKGROUND OF THE INVENTION

The present invention relates to a luggage structure to which an additional luggage case can be freely added so as to increase the capacity of the luggage.

FIG. 1 shows a conventional luggage structure in which a luggage case is mounted on a telescopic pull rod for placing clothes and other articles therein. The telescopic pull rod is disposed with a handle for dragging the luggage. Several shortcomings exist in such structure as follows:

1. The dimension of the luggage case of the conventional luggage structure is fixed and limited. Therefore, case is in the case that one luggage case is insufficient, it will be necessary to purchase another luggage. This increases the cost and storage room for the luggage.

2. In the case that one luggage is insufficient for totally containing the articles therein, a user may carry a bag to place the articles therein. However, the bag can hardly used with the luggage case as an integral unit.

3. The conventional luggage structure only has one single function of containing clothes and articles, while lacking any other function.

SUMMARY OF THE INVENTION

It is therefore a primary object of the present invention to provide a luggage structure to which an additional luggage case can be freely added so as to increase the capacity of the luggage without carrying any other separate bag. The luggage structure includes a luggage pull rod and a pair of adjustable latch boards. The user can adjustably secure an additional luggage case between the latch boards for containing not only the clothes, but also other articles as necessary.

The present invention can be best understood through the following description and accompanying drawings, wherein:

DETAILED DESCRIPTION OF THE PREFERRED EMBODIMENT

Figure 1:
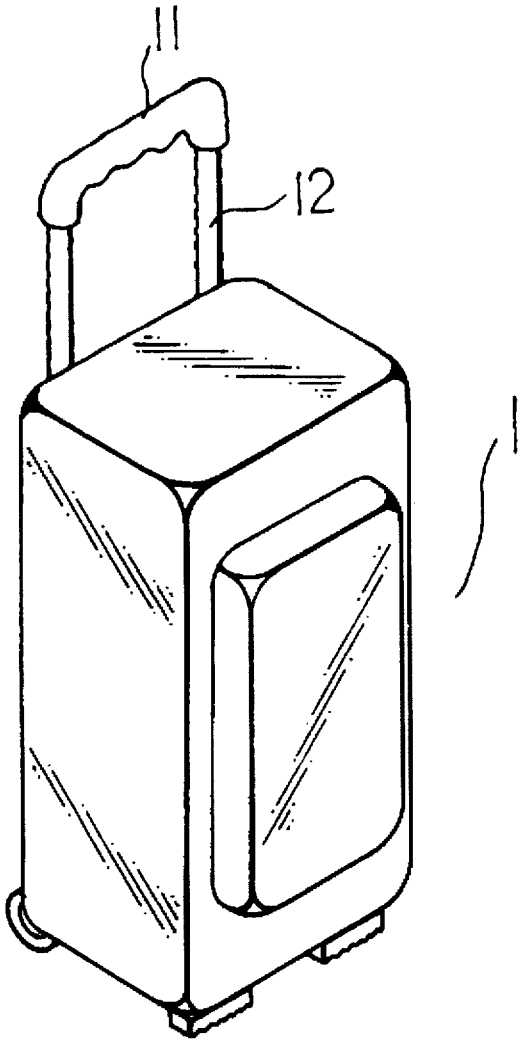
FIG. 1 PRIOR ART
FIG. 1 is a perspective view of a conventional luggage structure.
Figure 2:
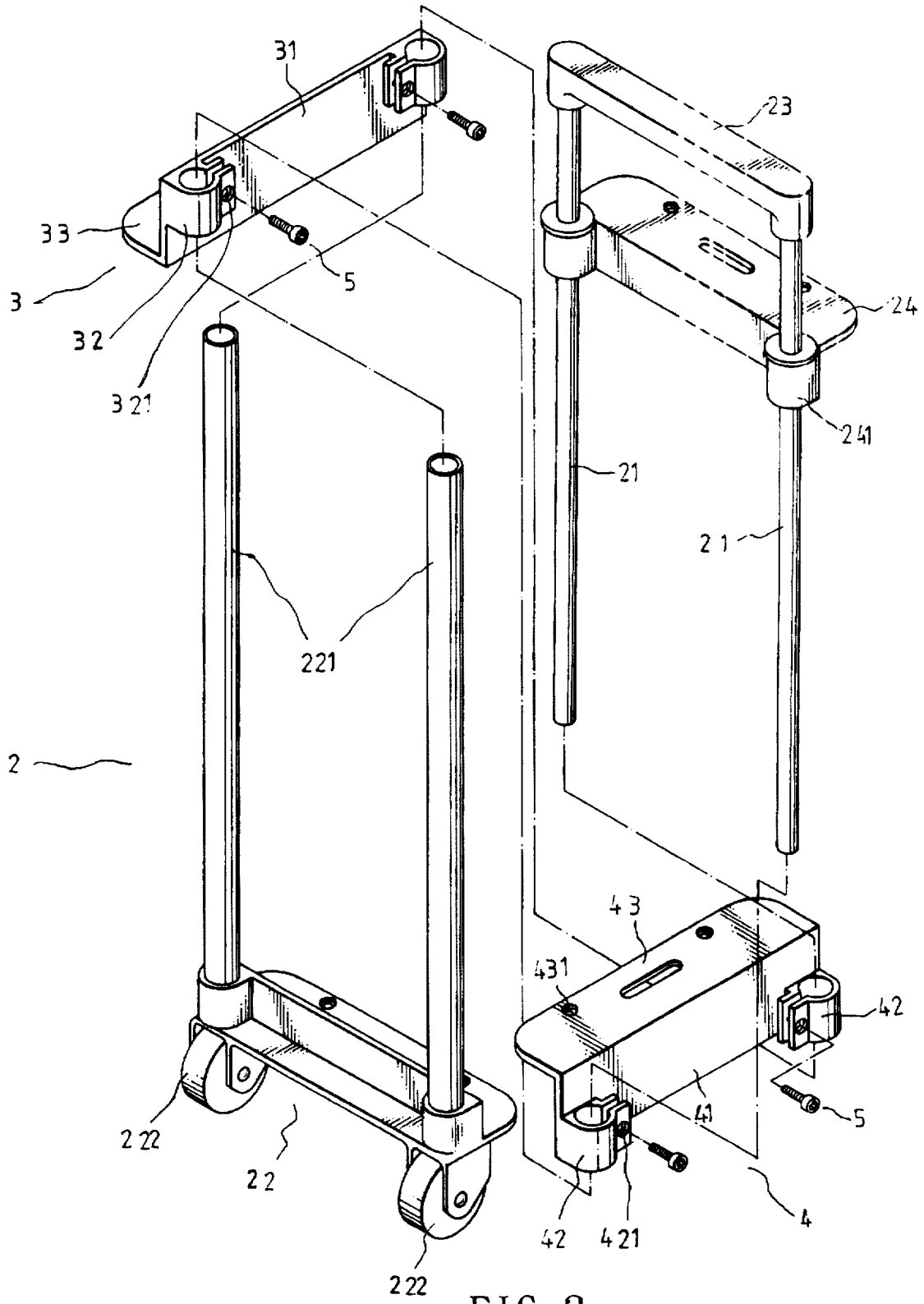
FIG. 2 is a perspective exploded view of the present invention.

Please refer to FIG. 2. The luggage structure of the present invention includes a luggage pull rod 2 and a pair of adjustable latch boards.

The luggage pull rod 2 includes a pair of inner tubes 21, a handle 23, an engaging board 24 and a base seat 22. The inner tubes 21 are respectively fitted into bottom sides of two ends of the handle 23. The engaging board 24 is fitted on the inner tubes 21 at a proper height. The inner tubes 21 are respectively fitted into two outer tubes 221 disposed on the base seat 22. The engaging board 24 is secured to the top ends of the outer tubes 221, whereby the handle 23 and the inner tubes 21 can be freely telescoped into or out of the outer tubes 221. A pair of wheels 222 are disposed under the base seat 22 for dragging the luggage.

The adjustable latch boards includes an upper pressing board 4 and a base board 3. The upper pressing board 4 is a reverse L-shaped board body having a vertical section 41 disposed with two latch clips 42 on two sides. Each latch clip 42 is disposed with a through hole 421 for a bolt 5 to tighten the outer tube 221. The horizontal section 43 of the pressing board is formed with several through holes 431 for riveting pin members 8 therein. The base board 3 is an L-shaped board body having a vertical section 31 disposed with two latch clips 32 on two sides. Each latch clip 32 is disposed with a through hole 321 for a bolt 5 to tighten the outer tube. The horizontal section 33 of the base board is formed with several through holes 331.

Figure 3:
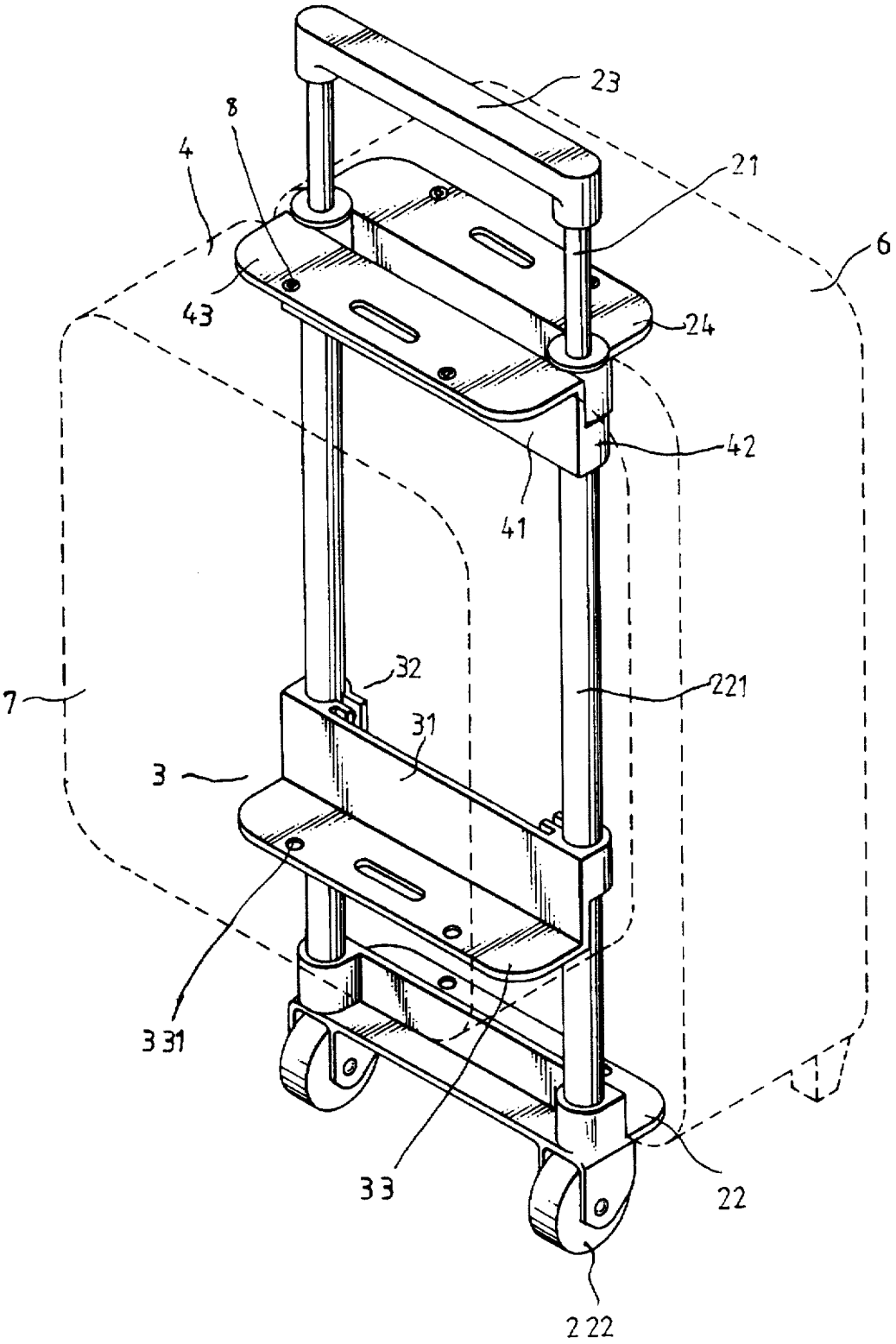
FIG. 3 is a perspective assembled view of the present invention, showing that an additional luggage case is secured between the latch boards.
Figure 4:
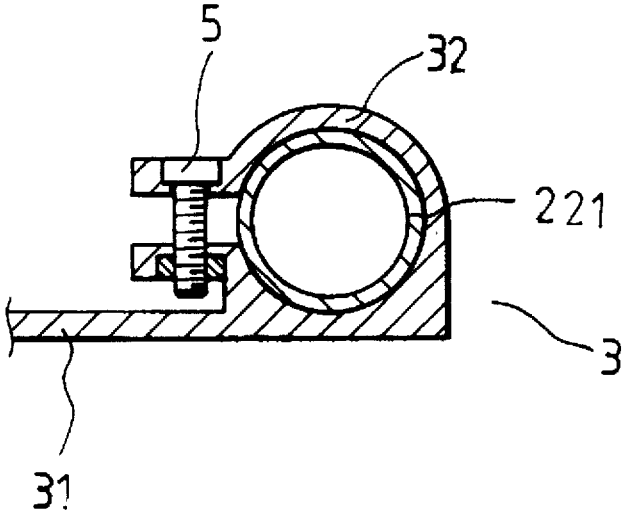
FIG. 4 is a sectional view showing that the outer tube is clipped by the latch clip of the present invention.

Referring to FIG. 3, a luggage case 6 is disposed between the engaging board 24 and the base seat 22 of the pull rod 2 as in a normal luggage structure. When it is desired to increase the capacity of the luggage, the upper pressing board 4 and the base board 3 can be adjusted to the upper and lower edges of the outer tubes 221 and the bolts 5 can be passed through the through holes 421, 321 of the latch clips 42, 32 to tighten the against outer tubes 221 therein as shown in FIG. 4, whereby the latch clips 42, 32 can clip and fix the outer tubes 221. Then the additional luggage case 7 can be positioned between the upper pressing board 4 and the base board 3. The pin members 8 are riveted in the through holes 431, 331 of the horizontal sections 43, 33 of the upper pressing board 4 and the base board 3 to secure the luggage case 7. Accordingly, an additional luggage case can be freely added to the luggage as necessary and the number and dimension of the luggage case can be changed according to different requirements.

The above embodiment is only an example of the present invention and the scope of the present invention should not be limited to the example. Any modification or variation derived from the example should fall within the scope of the present invention.

What is claimed is:

1. A luggage assembly comprising:

a) a telescoping handle comprising a pair of spaced apart outer tubes, an inner tube telescopically received in each of the outer tubes, the inner tubes having a handle attached to distal ends, a base seat fixedly connected to and extending between bottom end portions of the pair of outer tubes, the base seat having a plurality of wheels attached thereto, and an engaging board fixedly attached to and extending between upper end portions of the outer tubes;

b) a first luggage case attached to the base seat and the engaging board and located on a first side of the outer tubes;

c) a substantially "L"-shaped base board having a first wall section adjustably attached to the outer tubes and a second wall section;

d) a substantially inverted "L"-shaped upper pressing board having a third wall section adjustably attached to the outer tubes and a fourth wall section whereby the positions of the base board and the upper pressing board are adjustable relative to each other to vary a distance between the second and fourth wall sections; and, e) a second luggage case attached to the base board and the upper pressing board so as to be located on a second side of the outer tubes.

2. The luggage assembly of claim 1 wherein the second and fourth wall sections each have a plurality of holes therein.

3. The luggage assembly of claim 1 further comprising a plurality of latch clips extending from each of the base board and the upper pressing board to adjustably engage the outer tubes.

4. The luggage assembly of claim 3 wherein each latch clip comprises a generally "U"-shaped body having spaced apart ends and a fastening element engaging the spaced apart ends.

* * * * *